US005466142A

United States Patent [19]

Miani

[11] Patent Number: 5,466,142

[45] Date of Patent: Nov. 14, 1995

[54] TWO-COMPONENT EXTRUSION HEAD, HAVING A SPINNERET WITH HIGH PERFORATION DENSITY

[76] Inventor: Mario Miani, Via E. Fermi 9, 20017 RHO (Province of Milan), Italy

[21] Appl. No.: 128,413

[22] Filed: Sep. 30, 1993

[30] Foreign Application Priority Data

Oct. 19, 1992 [IT] Italy ..... MI92A2396

[51] Int. Cl.[6] ..... D01D 4/06; D01D 5/30

[52] U.S. Cl. ..... 425/131.5; 264/176.1; 264/172.11; 425/198; 425/463; 425/DIG. 217

[58] Field of Search ..... 264/171, 177.13, 264/176.1; 425/131.5, 464, 72.2, 463, 198, DIG. 217

[56] References Cited

U.S. PATENT DOCUMENTS

| | | | |
|---|---|---|---|
| 2,386,173 | 10/1945 | Kulp et al. | 425/131.5 |
| 3,341,891 | 9/1967 | Shimizu et al. | 425/131.5 |
| 3,344,472 | 10/1967 | Kitajima et al. | 425/131.5 |
| 3,413,683 | 12/1968 | Yelverton, Jr. | 425/131.5 |
| 3,480,996 | 12/1969 | Matsui . | |
| 3,553,774 | 1/1971 | Ruck et al. | 425/131.5 |
| 3,559,237 | 2/1971 | Biggelaar . | |
| 3,716,317 | 2/1973 | Williams . | |
| 4,248,577 | 2/1981 | Bory et al. | 264/177.13 |
| 4,406,850 | 9/1983 | Hills . | |
| 4,568,506 | 2/1986 | Kiriyama et al. | 425/72.2 |
| 4,717,325 | 1/1988 | Fujimura et al. | 425/131.5 |
| 4,846,653 | 7/1989 | Beck et al. | 425/131.5 |
| 5,035,595 | 7/1991 | Nakajima et al. | 425/131.5 |
| 5,234,650 | 8/1993 | Hagen et al. | 425/464 |
| 5,256,050 | 10/1993 | Davies | 425/131.5 |

FOREIGN PATENT DOCUMENTS 0434448 6/1991 European Pat. Off. .

OTHER PUBLICATIONS

Patent Abstract of Japan vol. 9, No. 91 (C–277) Apr. 19, 1985 & JP–A–59223 306 (Chisso KK) Dec. 15, 1984.

*Primary Examiner*—Jay H. Woo
*Assistant Examiner*—Joseph Leyson
*Attorney, Agent, or Firm*—Guido Modiano; Albert Josif

[57] ABSTRACT

The two-component extrusion head having a spinneret with high perforation density has a distribution unit for introducing a first component along a first direction and for introducing a second component along a second direction. The distribution unit introduces the two components with a preset distribution ratio between the two components in a transit region which is connected to a spinneret which has holes that extend along directions which are substantially parallel to the first direction and has a perforation density in excess of ten holes per square centimeter.

8 Claims, 2 Drawing Sheets

TWO-COMPONENT EXTRUSION HEAD, HAVING A SPINNERET WITH HIGH PERFORATION DENSITY

BACKGROUND OF THE INVENTION

The present invention relates to an extrusion head for two-component extruded threads, having a spinneret with high perforation density.

As is known, two-component threads are formed by mixing two different polymers, during the production of each thread, obtaining a thread in which the two components have a preset ratio.

This type of thread is currently possible with spinnerets having a limited number of perforations per square centimeter, i.e. in practice only some perforations per square centimeter, providing adequately constant distribution of the two components on the threads, whereas for the production of threads with spinnerets that have a high perforation density it is theoretically possible to manufacture two-component threads, but the distribution of the ratios between the two components is entirely random and thus very wide; i.e., statistical variance is very high.

This random distribution of the ratio between the two components is obviously bimodal if the two components have different viscosities, as usually occurs, to the point that separate spinning of the two components occurs for large viscosity differences.

Rheology allows to predict that the diameter of the threads is affected by the difference in viscosity and that threads richer in less viscous polymer have a diameter higher than the average.

SUMMARY OF THE INVENTION

An aim of the invention is indeed to solve the above described problem by providing an extrusion head for threads which can simultaneously extrude a very large number of threads, in excess of ten holes per square centimeter, in which the ratio between the two components has a very narrow distribution around a preset percentage.

Furthermore, in the extrusion of a two-component product formed by polymers having different viscosity, an object is to obtain a bimodal distribution that is much less evident than the natural one which would be obtained randomly, and equally limited differences in diameter due to difference in viscosity.

Within the scope of the above aim, a particular object of the invention is to provide an extrusion head wherein the two components are fed selectively and can merge together at the entry of the extrusion holes, so as to limit the distribution of the variation of the ratios between the two components and the variation in the count of the thread.

Another object of the present invention is to provide an extrusion head which is structurally simple and capable of giving the greatest assurances of reliability and safety in use.

Another object of the present invention is to provide an extrusion head in which it is possible to arrange, on request, one component adjacent to the other (side by side, S—S) or one of the two components fully around the other (sheath-core, S-C).

With the foregoing and other objects in view, there is provided a two-component extrusion head having a spinneret with high perforation density, characterized in that it comprises a distribution unit for introducing a first component along a first direction and for introducing a second component along a second direction, said distribution unit introducing said two components with a preset distribution ratio between the two components in a transit region which is connected to a spinneret which has holes that extend along directions which are substantially parallel to said first direction and has a perforation density in excess of ten holes per square centimeter.

BRIEF DESCRIPTION OF THE DRAWINGS

Further characteristics and advantages will become apparent from the description of a preferred but not exclusive embodiment of an extrusion head for two-component threads having a spinneret with high perforation density, illustrated only by way of non-limitative example in the accompanying drawings, which refer to a circular head and wherein.

DESCRIPTION OF THE PREFERRED EMBODIMENTS

Figure 1:
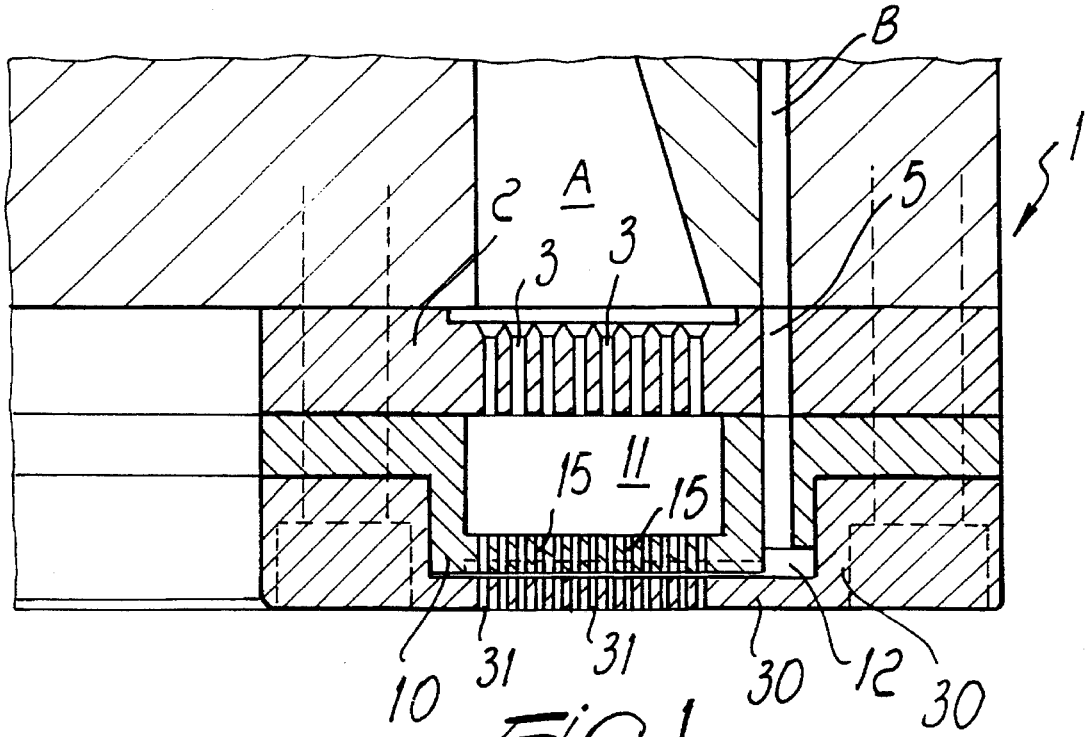
FIG. 1 is a schematic sectional view of the extrusion head, taken along the plane of the extrusion holes of the spinneret.
Figure 2:
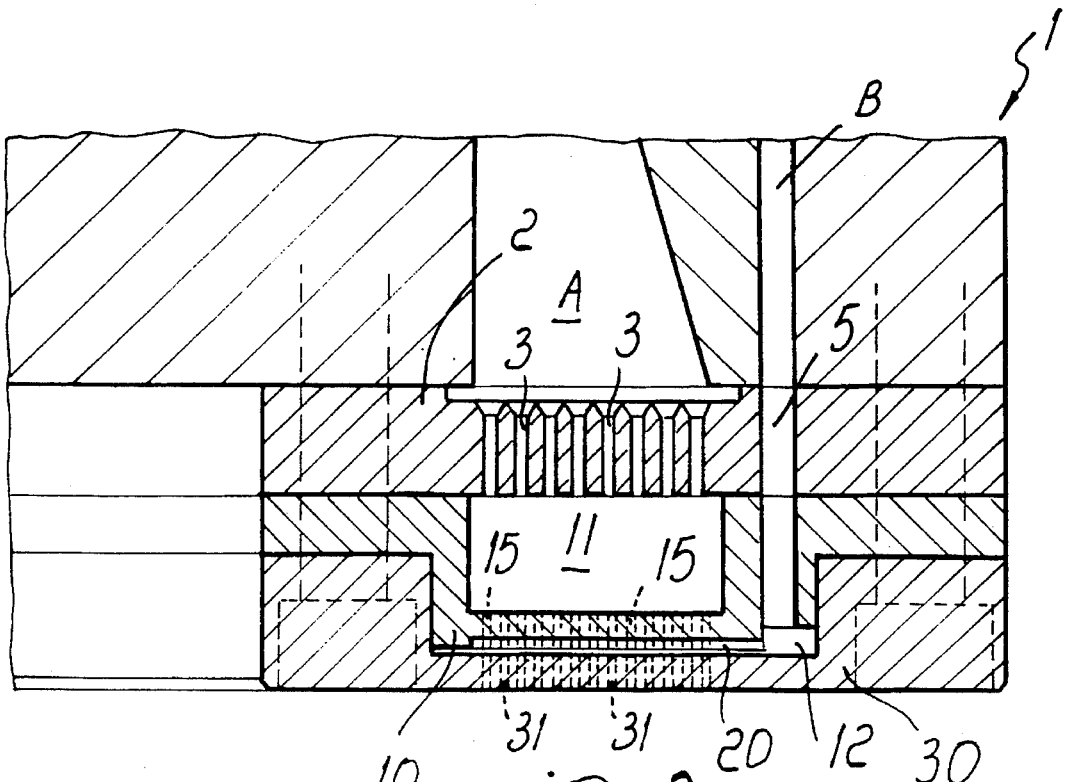
FIG. 2 is a schematic sectional view, taken along the distribution channels for the second component.
Figure 3:
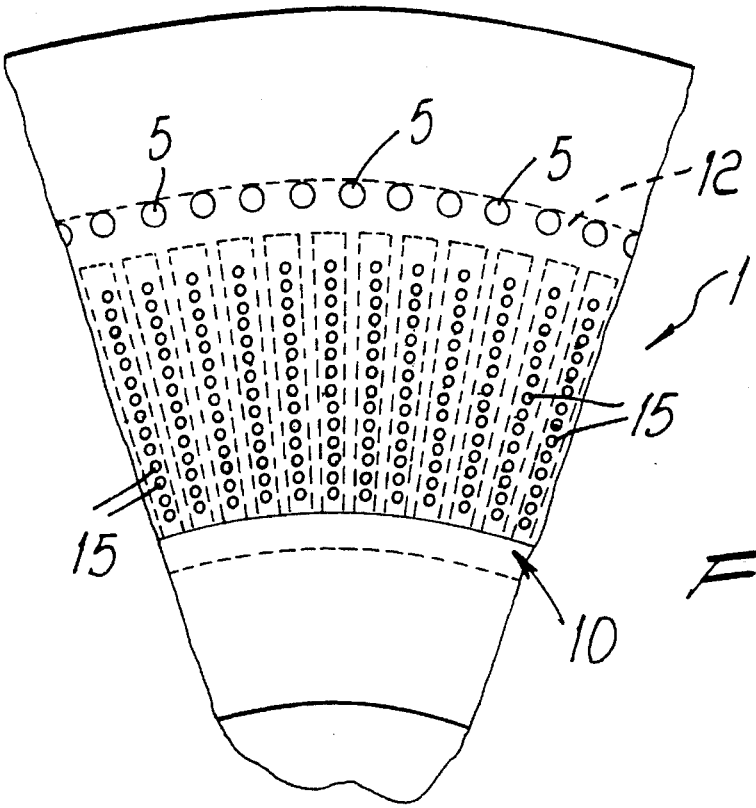
FIG. 3 is a schematic plan view of the distribution of the holes.
Figure 6:
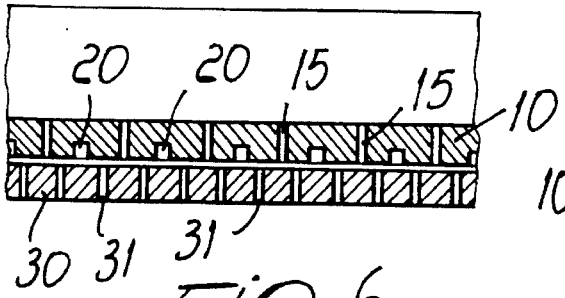
FIG. 6 is a schematic view of the mutual arrangement of the holes of the spinneret and of the holes of the distribution unit, for producing S-S threads.
Figure 4:
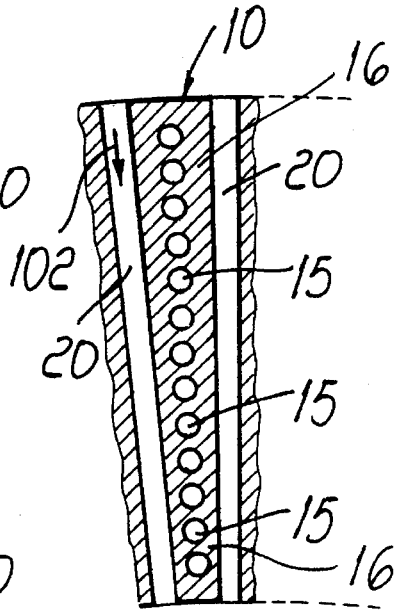
FIG. 4 is an enlarged-scale view of a detail related to the arrangement of the grooves for the distribution of the second component.

With reference to the above figures, the extrusion head for two-component threads having a spinneret with high perforation density, according to the invention, generally designated by the reference numeral 1, has a feeder plate 2 which receives the two polymers or components in two regions which are preferably annular and concentric.

The first component, designated by the reference letter A, passes through a plurality of holes 3 which can constitute a filtration region, whereas the second component B passes through transfer holes 5 which are normally provided outside the region affected by the filtration holes.

Downstream of the feeder plate along the polymer feeding direction there is a distribution plate 10 which forms, at the holes 3, a tank 11 for collecting the first component A and peripherally forms an annular tank 12 into which the second polymer B, introduced through the transfer holes 5, is conveyed.

The tank 11 allows the first polymer to pass through a plurality of distribution holes, designated by the reference numeral 15, which are preferably arranged radially and along circumferences and extend along a first direction which is coaxial to the extension of the spinneret.

From the tank 12, the second polymer B is introduced, by means of a plurality of radial slots or grooves 20, along a direction 102 at right angles to the direction 101 delimited by the distribution holes 15, and is conveyed into a transit region 21 arranged below the distribution plate and above a spinneret 30 with high perforation density which is provided with extrusion holes 31 extending along directions which are substantially parallel to the direction of transit through the distribution holes 15.

In order to obtain the required distribution ratio between the two components it is necessary to adjust the sections for the transit of the second component, i.e. in practice the paths that the second component must follow in order to reach the holes of the spinneret and merge with the first component.

By providing radial passages or slots 20 which preferably have constant width and depth, the distance between the edge of the related slot in which the second polymer B flows and the holes 15 in which the first polymer A flows decreases progressively from the peripheral region toward the center of the distribution plate.

Figure 5:
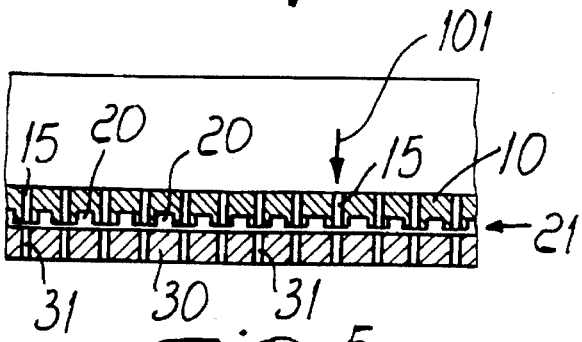
FIG. 5 is a sectional view of the mutual arrangement of the holes of the spinneret and of the holes of the distribution unit, for producing S-C threads.

The position of the holes of the distribution plate with respect to the holes of the spinneret is determined according to the type of two-component product required; in the case of a sheath-core two-component product, the distribution holes, as indicated in FIG. 5, are axially aligned with the holes of the spinneret and the grooves are arranged inside; in this manner the first component is substantially sheathed by the second component.

Instead, for the production of side-by-side threads the holes of the distribution plate are offset with respect to the holes of the spinneret, so that the two components in practice arrange themselves side by side in the holes in the spinneret. The arrangement of the holes, as mentioned above, is the condition that ensures that the same amount of polymer A flows out of each hole of the spinneret, but in order to ensure that the same amount of polymer B flows out of all the holes, the total pressure drop from the annular tank 12 of the second component to the holes of the spinneret must be the same for each hole, i.e. the pressure drop must be the same total for the holes located closer to the tank and for those which are more distant.

The opening formed by the transit area which in practice is located in the triangular sectors 16 formed by the distribution along the radial edge of the holes, causes the distance at the outer peripheral regions to be greater than the distance of the internal regions, so that the total pressure drop remains substantially constant along any path toward a hole.

The passage gap, i.e. essentially the gap formed by the slots and by the distance between the spinneret and the distribution plate, is preferably the same along the radius, whereas the length along the circumference decreases progressively from the outer ring of holes toward the center.

This decreasing length from the peripheral region toward the center is obtained in practice simply by giving a constant width to the slots that are arranged radially.

Consequently, for an equal amount of flowing material, the partial pressure drop of the second polymer B that passes from the radial slot to the holes of the spinneret through the gap formed by the passage region decreases progressively from the outer ring of holes toward the center, i.e., in practice, the holes have, in the central region, a shorter distance with respect to the slots, consequently compensating the partial pressure drop produced by the longer path in the slot.

Since the second polymer B that flows in the slots of the outer tank toward the center is at a higher pressure in the outside region than at the center, for any kind of polymer B it is possible to calculate and form a passage gap between the distribution unit and the spinneret such that the partial pressure drop along the slot is practically equal to the pressure difference between the outside and the inside, so that a constant amount of polymer flows through the gap formed between the distribution unit and the spinneret and thus the same amount of second component enters each hole of the spinneret, whereas as regards the first component, since there is a positional relation between the holes of the spinneret and those of the distribution plate, the amount of first component is substantially the same in all the holes.

By virtue of the distribution obtained for the feeding of the second component, it is thus possible to obtain a two-component product which has a substantially constant distribution ratio.

It is evident that in the production of two-component threads it is possible to make the same amount of second polymer B flow toward each hole, thus ensuring a very narrow distribution curve for the percentage of the two polymers, i.e. considerable uniformity in distribution.

From what has been described above it can thus be seen that the invention achieves the intended aim and objects, and in particular the fact is stressed that a two-component spinneret is formed which can produce threads from 1 to 30 decitex (thread diameters from 10 to 70 microns) with spinnerets having 40 to 200 holes per square centimeter, as well as threads above 50 decitex (thread diameters above 70 microns) with spinnerets having 10 to 40 holes per square centimeter.

The important characteristic of the invention is constituted by the fact that by virtue of the distribution of the components along two different directions, and by using for the second component a geometrical distribution which produces uniform total pressure drop along the entire path, it is possible to uniformly adjust, for all the holes, the amount of second component which combines with the first component which is fed from holes which obviously allow to obtain uniform distribution for the first component as well; consequently, the two-component product extruded in the spinneret with high perforation density has a substantially equal distribution of the ratio between the components in all the holes, with a preselectable ratio.

The invention thus conceived is susceptible to numerous modifications and variations, all of which are within the scope of the inventive concept.

All the details may furthermore be replaced with other technically equivalent elements.

In practice, the materials employed, as well as the contingent shapes and dimensions, may be any according to the requirements.

I claim:

1. Extrusion head for two-component threads comprising;

a distribution plate (10) having a center and a periphery;

a spinneret (30);

a transit region (21) defined between said distribution plate (10) and said spinneret (30);

a first tank (11) defined by said distribution plate (10) for containing a first component (A) of a two-component thread;

a plurality of distribution holes (15) formed in said distribution plate (10) and extending from said tank (11) to said transit region (21);

an annular tank (12) defined by said distribution plate (10) surrounding said distribution holes for containing a second component (B) of a two-component thread;

a plurality of radial passages (20) defined on said distribution plate and extending at right angles with respect to said distribution holes (15), said radial passages (20) extending from said annular tank (12) and through said transit region (21) between said distribution plate (10) and said spinneret (30), said radial passages communicating with said transit region, and;

a plurality of extrusion holes (31) formed in said spinneret

(30) and communicating with said transit region (21) for extrusion of two-component threads;

wherein said extrusion holes (31) are formed in said spinneret with a perforation density of from 10 to 200 extrusion holes (31) per square centimeter, and wherein said radial passages (20) are spaced from said distribution holes (15) by a circumferential distance which decreases from said periphery towards said center of said distribution plate (10), whereby progressive pressure drop occurring as fluid (B) passes radially along any of said radial passages (20) towards the center of said distribution plate (10) is compensated by a progressively smaller circumferential distance separating each of said radial passages (20) from said distribution holes (15).

2. Extrusion head according to claim 1, wherein said plurality of extrusion holes (31) are formed in said spinneret (30) with a perforation density of from 10 to 40 extrusion holes (31) per square centimeter for forming two-component threads having a diameter greater than 70 microns.

3. Extrusion head according to claim 1, wherein said plurality of extrusion holes (31) are formed in said spinneret (30) with a perforation density of from 40 to 200 extrusion holes (31) per square centimeter for producing two-component threads having a diameter of from 10 to 70 microns.

4. Extrusion head according to claim 1, wherein said plurality of distribution holes (15) of said distribution plate (10) are axially aligned with said plurality of extrusion holes (31) of said spinneret (30), for extruding a sheath-core two-component threads.

5. Extrusion head according to claim 1, wherein said plurality of distribution holes (15) of said distribution plate (10) are axially offset with respect to said plurality of extrusion holes (31) of said spinneret (30), for extruding side-by-side two-component threads.

6. Extrusion head according to claim 1, further comprising;

a feeder plate (2), said distribution plate (10) being located between said feeder plate (2) and said spinneret (30);

at least one region defined in said feeder plate (2) for containing a first component (A) of a two-component thread;

at least another region defined in said feeder plate (2) for containing a second component (B) of a two-component thread;

a plurality of holes (3) formed in said feeder plate (2) and extending between said one region and said first tank (11), and;

a plurality of transfer holes (5) formed in said feeder plate and extending between said other region and said annular tank (12).

7. Extrusion head according to claim 6, wherein said plurality of holes (3) formed in said feeder plate (2) and extending between said one region and said first tank constitute a filtration region (3) for a first component (A) of a two-component thread, and wherein said transfer holes (5) are formed in said feeder plate (2) at a location outside said filtration region (3).

8. Extrusion head for two-component threads comprising;

a distribution plate (10) having a center and a periphery;

a spinneret (30);

a transit region (21) defined between said distribution plate (10) and said spinneret (30);

means (11) defined by said distribution plate (10) for containing a first component (A) of a two-component thread;

a plurality of distribution holes (15) formed in said distribution plate (10) and extending from said means (11) for containing a first component to said transit region (21);

means (12) for containing a second component (B) of a two-component thread surrounding said distribution holes;

a plurality of radial passages (20) defined on said distribution plate, said radial passages (20) extending from said means (12) for containing a second component and through said transit region (21), said radial passages communicating with said transit region, and;

a plurality of extrusion holes (31) formed in said spinneret (30) and communicating with said transit region (21) for extrusion of two-component threads;

wherein said extrusion holes (31) are formed in said spinneret with a perforation density of from 10 to 200 extrusion holes (31) per square centimeter, and wherein said radial passages (20) are spaced from said distribution holes (15) by a circumferential distance which decreases from said periphery towards said center of said distribution plate (10), whereby progressive pressure drop occurring as fluid (B) passes radially along any of said radial passages (20) towards the center of said distribution plate (10) is compensated by a progressively smaller circumferential distance separating each of said radial passages (20) from said distribution holes (15).

* * * * *